US007798591B2

(12) United States Patent
Ishizaki

(10) Patent No.: US 7,798,591 B2
(45) Date of Patent: Sep. 21, 2010

(54) CAPACITIVE LOAD DRIVING CIRCUIT AND DROPLET EJECTION APPARATUS

(75) Inventor: Sunao Ishizaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 251 days.

(21) Appl. No.: 12/109,446

(22) Filed: Apr. 25, 2008

(65) Prior Publication Data

US 2009/0160891 A1 Jun. 25, 2009

(30) Foreign Application Priority Data

Dec. 19, 2007 (JP) ..... 2007-327613

(51) Int. Cl.
*B41J 29/38* (2006.01)

(52) U.S. Cl. ..... 347/14; 347/10; 347/11

(58) Field of Classification Search ..... None
See application file for complete search history.

(56) References Cited

U.S. PATENT DOCUMENTS

| | | | | |
|---|---|---|---|---|
| 5,526,252 | A * | 6/1996 | Erdman | 363/41 |
| 6,312,076 | B1 | 11/2001 | Taki et al. | |
| 6,454,377 | B1 | 9/2002 | Ishizaki | |
| 7,244,007 | B2 | 7/2007 | Ishizaki | |
| 2005/0231179 | A1 | 10/2005 | Ishizaki | |
| 2007/0079710 | A1 | 4/2007 | Ishizaki | |
| 2007/0165074 | A1 | 7/2007 | Ishizaki | |

FOREIGN PATENT DOCUMENTS

| | | |
|---|---|---|
| JP | 58-101201 | 7/1983 |
| JP | 02-129702 | 5/1990 |
| JP | 2940542 | 1/1999 |
| JP | 2000-117980 | 4/2000 |
| JP | 3223891 | 4/2000 |
| JP | 2000-218782 | 8/2000 |
| JP | 2005-080424 | 3/2005 |
| JP | 2005-329710 | 12/2005 |
| JP | 2007-096364 | 4/2007 |
| JP | 2007-168172 | 7/2007 |
| JP | 2007-190708 | 8/2007 |

* cited by examiner

*Primary Examiner*—Matthew Luu
*Assistant Examiner*—Justin Seo
(74) *Attorney, Agent, or Firm*—Fildes & Outland, P.C.

(57) ABSTRACT

A capacitive load driving circuit includes: a phase lead compensator, advancing a phase of an output signal of a filter; a series compensator, determining an error between a driving signal and an output signal of the phase lead compensator; a stabilization compensator, performing a derivative action on an output signal of the filter; a voltage comparison unit, comparing a differential voltage between a signal output from the series compensator and a signal output from the stabilization compensator, with a voltage of a predetermined triangular waveform, and outputting a pulse width modulation signal; a voltage amplification unit, amplifying the voltage of the pulse width modulation signal output, and supplying the amplified pulse width modulation signal to the input terminal of the filter; and plural capacitive loads each connected in parallel to the capacitor. A droplet ejection apparatus includes the capacitive load driving circuit.

8 Claims, 15 Drawing Sheets

CAPACITIVE LOAD DRIVING CIRCUIT AND DROPLET EJECTION APPARATUS

CROSS-REFERENCE TO RELATED APPLICATION

This application claims priority under 35 USC 119 from Japanese Patent Application No. 2007-327613 filed Dec. 19, 2007.

BACKGROUND

1. Technical Field

The present invention relates to a capacitive load driving circuit and a droplet ejection apparatus.

2. Related Art

Conventionally, a drive circuit of an ink jet head ejects ink droplets from nozzles provided respectively to piezoelectric elements provided in a piezoelectric head by supplying an analog driving signal to the piezoelectric elements provided. Since the piezoelectric elements are capacitive elements, electrostatic capacity, which is a load, of the piezoelectric head increases as the number of piezoelectric elements driven simultaneously increases. Thus, there is a problem that a waveform of a driving signal input into the piezoelectric element is weakened such that a stable operation cannot be realized.

SUMMARY

A first aspect of the invention is a capacitive load driving circuit including: a filter having an inductor, one end of which is connected to an input terminal and another end of which is connected to an output terminal, and a capacitor having a fixed electrostatic capacity, and one electrode of which is connected to the output terminal, and another electrode of which is grounded; a plurality of capacitive loads, each of which is connected in parallel to the capacitor and any one of the capacitive loads is driven; a phase lead compensator that advances a phase of an output signal of the filter; a series compensator that determines an error between a driving signal and an output signal of the phase lead compensator and outputs a signal on which a proportional integral operation has been performed; a stabilization compensator that is configured independently of the series compensator and outputs a signal obtained by performing a derivative action on an output signal of the filter; a voltage comparison unit that compares a differential voltage between a signal output from the series compensator and a signal output from the stabilization compensator and a voltage of predetermined triangular waves and outputs a pulse width modulation signal; and a voltage amplification unit that amplifies the voltage of the pulse width modulation signal output from the voltage comparison unit and supplies the amplified pulse width modulation signal to the input terminal of the filter.

BRIEF DESCRIPTION OF THE DRAWINGS

Exemplary embodiments of the present invention will be described in detail based on the following figures, wherein.

DETAILED DESCRIPTION OF THE INVENTION

Exemplary embodiments of the present invention will be described in detail below with reference to drawings.

First Exemplary Embodiment

Figure 1:
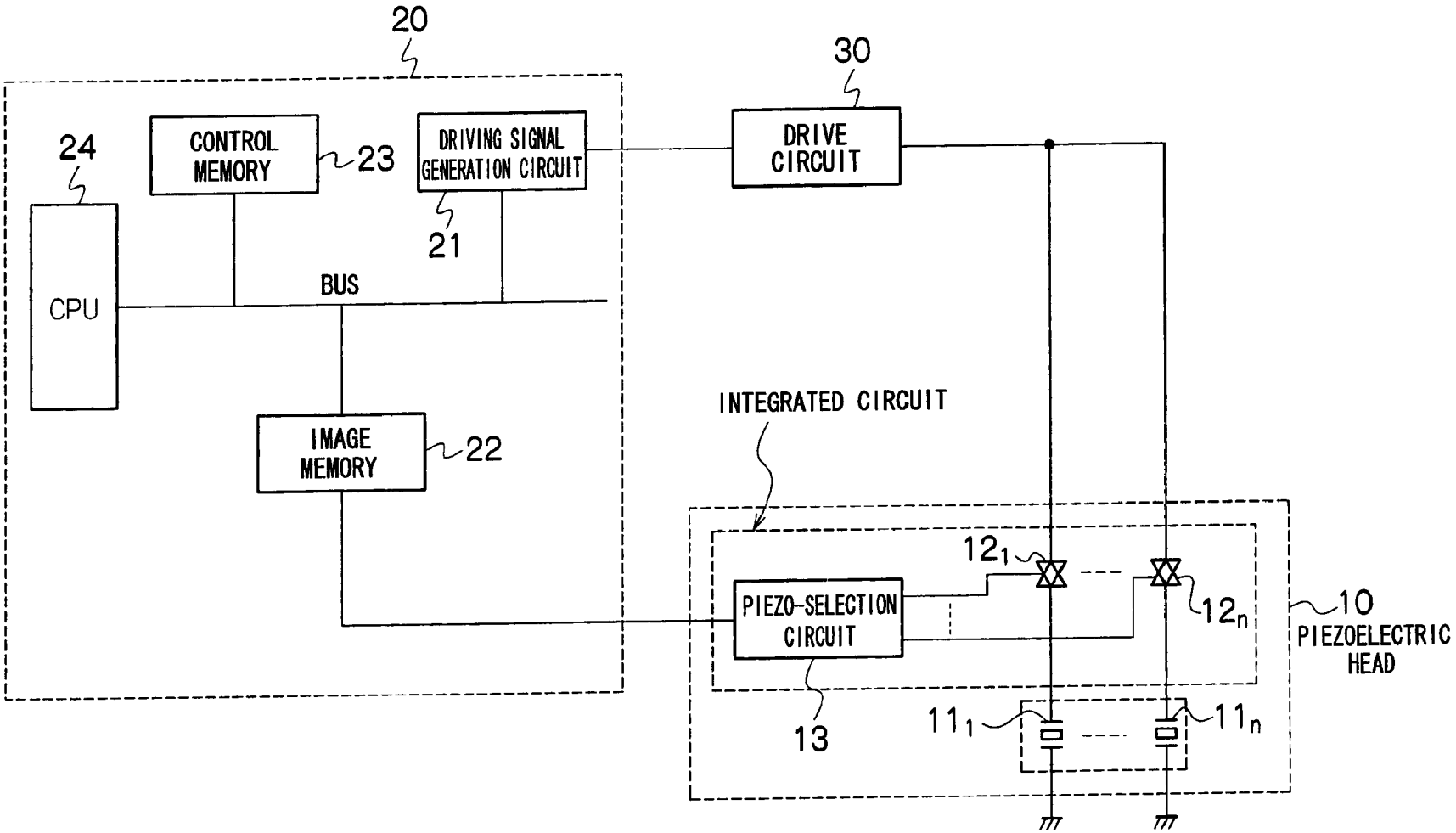
FIG. 1 is a block diagram showing a configuration of an ink jet printer according to an exemplary embodiment of the present invention.

FIG. 1 is a block diagram showing the configuration of an ink jet printer according to a first exemplary embodiment of the invention. The ink jet printer has a piezoelectric head 10 for ejecting ink, a control unit 20 for controlling ejection of ink, and a drive circuit 30 for driving the piezoelectric head 10 based on control of the control unit 20.

The piezoelectric head 10 has an ejection element group in which ejection elements, each of which includes n (n is a natural number) piezoelectric elements $\mathbf{11}_1$ to $\mathbf{11}_n$, are accumulated, n transmission gates $\mathbf{12}_1$ to $\mathbf{12}_n$, each of which is connected to the respective piezoelectric element $\mathbf{11}_1$ to $\mathbf{11}_n$ in series to be turned on or turned off, and a piezo-selection circuit 13 for controlling on or off of the transmission gates $\mathbf{12}_1$ to $\mathbf{12}_n$ to select any one of the piezoelectric elements $\mathbf{11}_1$ to $\mathbf{11}_n$.

Subscripts (1 to n) of numerals are used to distinguish each piezoelectric element or transmission gate and are omitted when there is no need for distinction.

Figure 2:
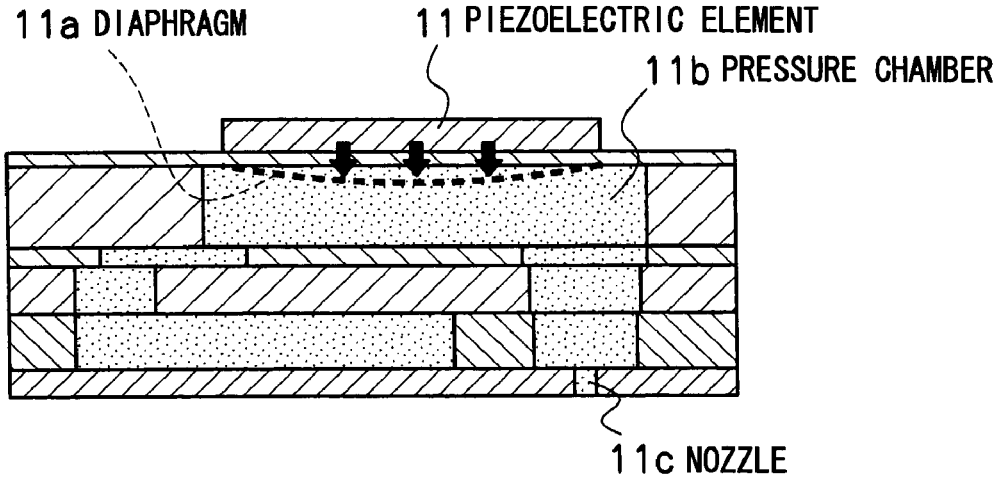
FIG. 2 is a diagram showing the configuration of an ejection element.

FIG. 2 is a diagram showing the configuration of an ejection element. The piezoelectric head 10 is produced by integrating about 100 to 1000 of the ejection elements shown in FIG. 2. When a voltage changing over time is applied to the piezoelectric element 11 in each ejection element, a diaphragm 11*a* vibrates in accordance with fluctuations of the piezoelectric element 11 and the volume of a pressure chamber 11*b* filled with liquid ink changes before droplets are thereby ejected from a nozzle 11*c*.

The control unit 20 has a driving signal generation circuit 21 for generating a driving signal, an image memory 22 for storing image data, a control memory 23 for storing control data, and a CPU 24 for performing overall control.

The CPU 24 uses the control data stored in the control memory 23 to cause the driving signal generation circuit 21 to generate a predetermined driving signal. The CPU 24 also controls the piezo-selection circuit 13 of the piezoelectric head 10 to suitably select an ejection element based on the image data stored in the image memory 22 so that the transmission gate 12 corresponding to the ejection element is turned on.

Figure 3:
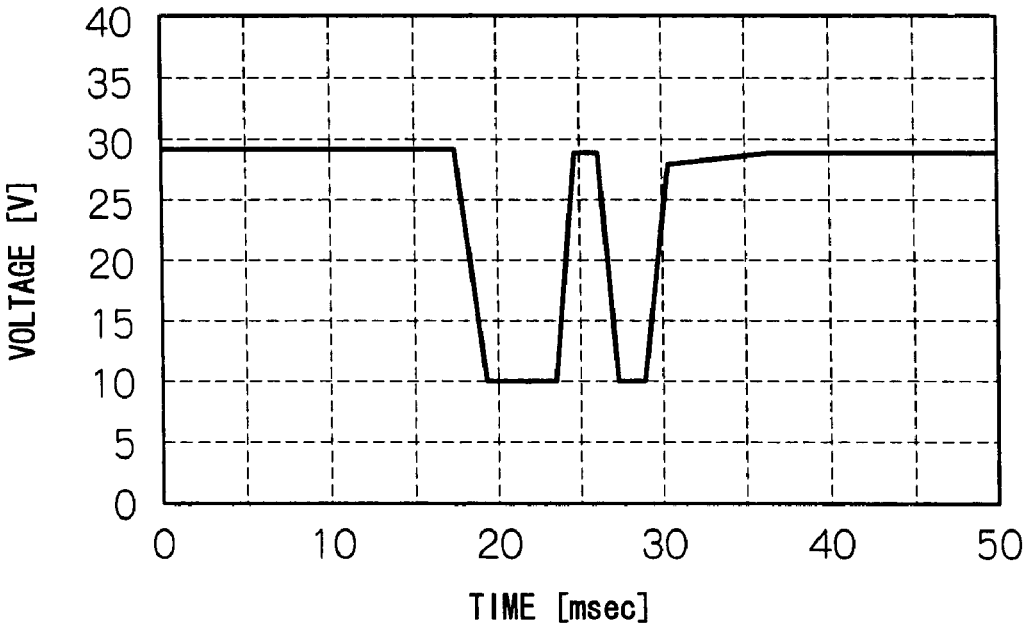
FIG. 3 is a diagram showing a driving signal.

The drive circuit 30 provides, for example, a driving signal shown in FIG. 3 to the piezoelectric head 10. The frequency band of the driving signal broadens with increasing ejection frequencies and reaches several hundred kHz in the example shown in FIG. 3.

A driving signal $V_1$, which is a fixed multiple times voltage of the driving signal shown in FIG. 3, is input into the drive circuit 30. More specifically, if the voltage amplification factor (the ratio of an input voltage $V_1$ of the drive circuit to a filter voltage $V_2$) of the drive circuit 30 is 20, while the maximum value of the driving signal shown in FIG. 3 is 29 [V], that of the input voltage $V_1$ is 1.45 [V].

Here, the piezoelectric element 11 in the piezoelectric head 10 is capacitive. Thus, the drive circuit 30 drives the piezoelectric head 10, which is a load whose electrostatic capacity changes in accordance with the number of dots to be driven.

Incidentally, the piezoelectric elements $\mathbf{11}_1$ to $\mathbf{11}_n$ are connected in parallel to a fixed-capacity capacitor $C_0$ constituting a filter 34 shown in FIG. 5 later. Therefore, frequency characteristics of the filter 34 are determined by an inductor L, the capacitor $C_0$, and electrostatic capacity $C_p$ whose capacity changes depending on the number of piezoelectric elements $\mathbf{11}_1$ to $\mathbf{11}_n$ to be driven.

Figure 4:
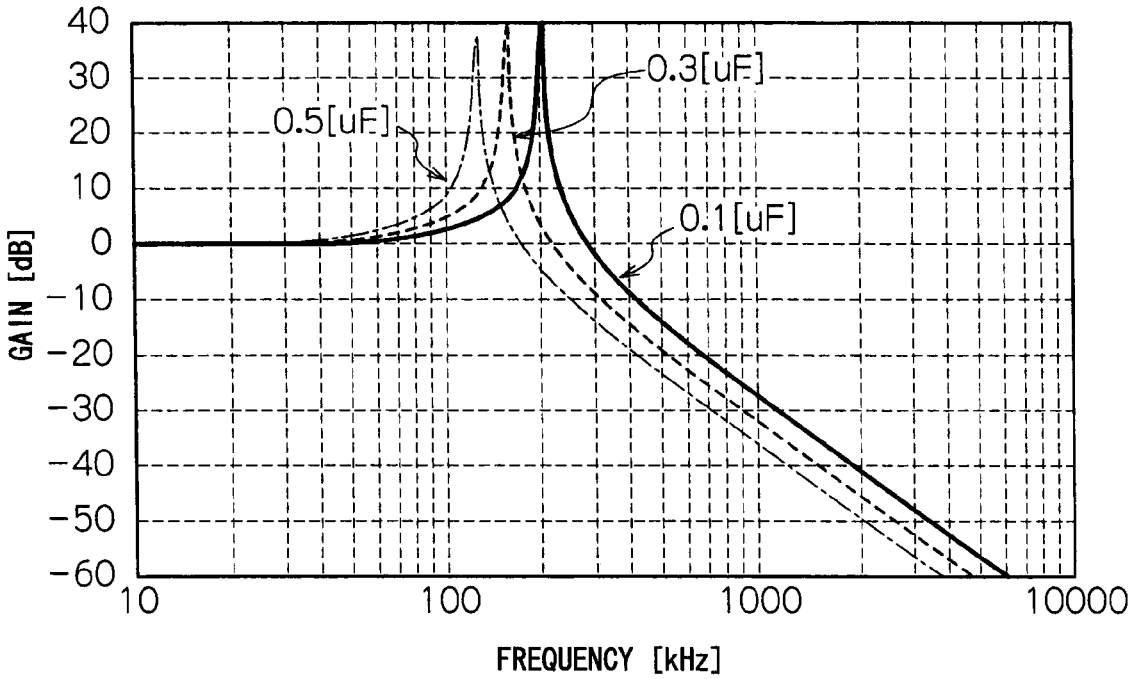
FIG. 4 is a diagram exemplifying frequency characteristics.

If for example, the electrostatic capacity of one piezoelectric element 11 is 400 [pF], the electrostatic capacity $C_p$ viewed from the drive circuit 30 when an image of 250 dots is formed is 0.1 [μF]. Here, filter frequency characteristics when L=2.2 [μF], $C_0$=0.2 [μF], and $C_p$=0.1, 0.3, 0.5 [μF] are as shown in FIG. 4.

Figure 5:
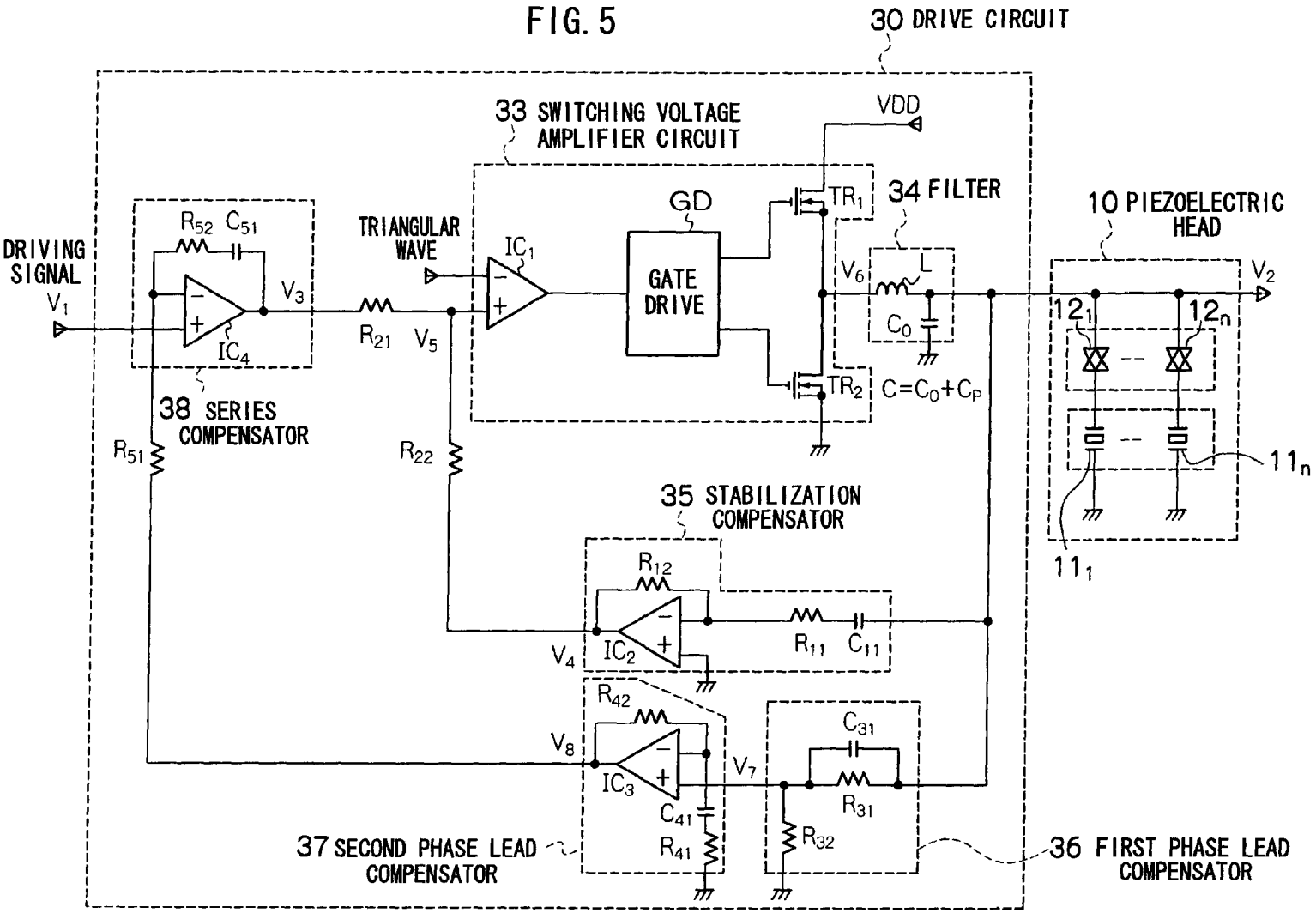
FIG. 5 is a circuit diagram showing the configuration of a drive circuit.
Figure 6:
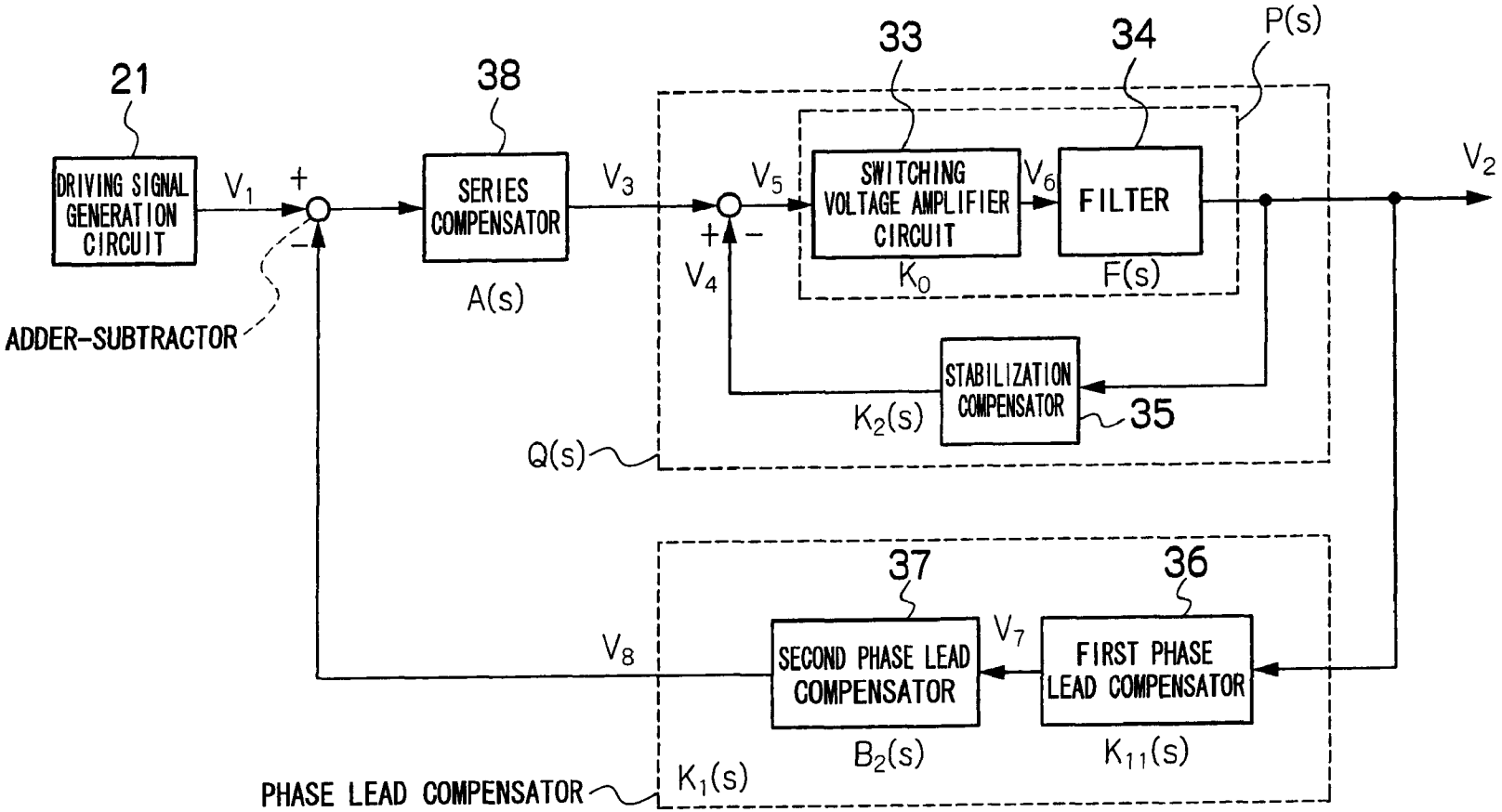
FIG. 6 is a diagram showing transfer functions of each of circuits constituting the drive circuit.

Configuration of the Drive Circuit 30:

FIG. 5 is a circuit diagram showing the configuration of the drive circuit 30. FIG. 6 is a diagram showing transfer functions of each of circuits constituting the drive circuit 30.

The drive circuit 30 has a switching voltage amplifier circuit 33, the filter 34, a stabilization compensator 35 for stabilizing a control target, a first phase lead compensator 36 for making phase lead compensation to prevent oscillations during feedback, a second phase lead compensator 37 connected in series to the first phase lead compensator 36, and a series compensator 38.

Switching Voltage Amplifier Circuit 33

The switching voltage amplifier circuit 33 has a comparator $IC_1$, a gate drive circuit GD, and a first transistor $TR_1$ and a second transistor $TR_2$ constituted by, for example, MOSFET.

A non-inversion input terminal of the comparator $IC_1$ is connected to an output terminal of an operational amplifier $IC_4$ via a resistor R21. Triangular waves are input into an inversion input terminal of the comparator $IC_1$. An output terminal of the comparator $IC_1$ is connected to an input terminal of the gate drive circuit GD. A first output terminal of the gate drive circuit GD is connected to a gate of the first transistor $TR_1$ and a second output terminal thereof is connected to a gate of the second transistor $TR_2$.

A high-voltage source is applied to a drain of the first transistor $TR_1$. A source of the first transistor $TR_1$ is connected to a drain of the second transistor $TR_2$. A source of the second transistor $TR_2$ is grounded. Then, the source of the first transistor $TR_1$ (the drain of the second transistor $TR_2$) becomes an output terminal of the switching voltage amplifier circuit 33. An output terminal of the switching voltage amplifier circuit 33 is connected to the piezoelectric head 10 via the filter 34.

The comparator $IC_1$ compares an amplitude of a preset triangular wave and that of an analog signal V5 output from the operational amplifier $IC_4$. The comparator $IC_1$ outputs a pulse signal of logic '0' if the amplitude of the triangular wave is larger and outputs a pulse signal of logic '1' if the amplitude of V5 is larger. Therefore, the comparator $IC_1$ is a pulse width modulation circuit whose cycle Ts is the same as that of the triangular wave and that outputs a pulse signal in proportion to the amplitude of an input analog signal and of the ratio (duty ratio) of a time $T_{ON}$ of logic '1' to a time TS-$T_{ON}$ of logic '0'. The amplitude of the output signal is generally 3 to 5 [V].

The gate drive circuit GD amplifies the amplitude of a pulse signal output from the comparator $IC_1$ to a voltage at which the transistors $TR_1$ and $TR_2$ are operable. Then, if the pulse signal from the comparator $IC_1$ is logic '1', the gate drive circuit GD outputs a voltage that turns on the transistor $TR_1$ and also a voltage that turns off the transistor $TR_2$. If the pulse signal from the comparator $IC_1$ is logic '0', the gate drive circuit GD outputs a voltage that turns off the transistor $TR_1$ and also a voltage that turns on the transistor $TR_2$.

Figure 7:
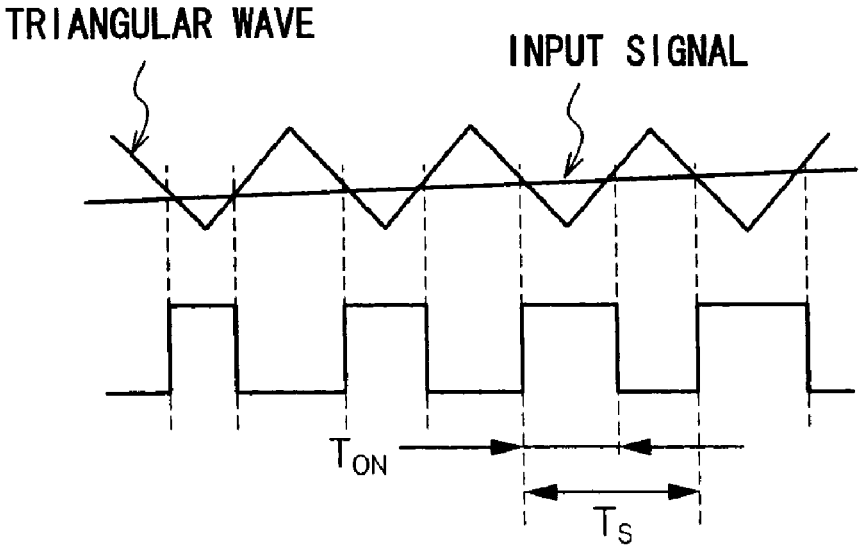
FIG. 7 is a diagram showing a pulse width modulation signal generated from a triangular wave and an input signal.

The transistors $TR_1$ and $TR_2$ complementarily perform a switching operation in accordance with a pulse signal output from the gate drive circuit GD. An output voltage 6 V of the switching voltage amplifier circuit 33 is similar to a pulse signal shown in FIG. 7. The output voltage 6 V is equal to a supply voltage VDD if a voltage drop due to channel resistance is excluded.

Here, the maximum voltage that can be input into the switching voltage amplifier circuit 33 is a maximum voltage $V_T$ of the triangular wave and the maximum output voltage is the supply voltage VDD. Therefore, the voltage amplification factor $K_0$ of the switching voltage amplifier circuit 33 is given by Equation 1:

$$K0=V_{DD}/V_T \tag{1}$$

If designed, for example, with $V_T$=3.5 [V] and $V_{DD}$=40 [V], $K_0$ will be 11.4 (21.1 [dB]).

Filter 34

The filter 34 has the inductor L, one terminal of which is connected to the output terminal of the switching voltage amplifier circuit 33 and the other terminal of which becomes a filter output terminal and the capacitor $C_0$, one electrode of which is connected to the filter output terminal and the other electrode of which is grounded.

A capacity C of a capacitor is the sum of the fixed capacity $C_0$ and the electrostatic capacity $C_p$ that changes depending on the number of dots to be printed. A resonance frequency $f_0$ of a filter is given by Equation 2 and an angular frequency $\omega_0$ is given by Equation 3:

$$f_0 = \frac{1}{2\pi\sqrt{LC}} \tag{2}$$

$$\omega_0 = 2\pi f_0 \tag{3}$$

A transfer function F(s) from input V6 to output $V_2$ of the filter 34 is given by Equation 4:

$$F(s) = \frac{\omega_0^2}{s^2 + \omega_0^2} \tag{4}$$

where s is a Laplace variable and a relation with a frequency f is defined by Equation 5:

$$s=j2\pi f,\ j=\sqrt{-1} \tag{5}$$

As shown in FIG. 6, a transfer function from input V5 of the switching voltage amplifier circuit 33 to the output $V_2$ of the filter 34 is defined as P(s). P(s) is expressed by Equation 6, which is a product of Equation 1 and Equation 4. Equation 6 is called a control target.

$$P(s) = K_0 F(s) = \frac{K_0 \omega_0^2}{s^2 + \omega_0^2} \tag{6}$$

An output terminal of the filter 34 is connected to the stabilization compensator 35 and the first phase lead compensator 36.

Stabilization Compensator 35

The stabilization compensator 35 has an operational amplifier $IC_2$. An inversion input terminal of the operational amplifier $IC_2$ is connected to an output side of the filter 34 via a resistor $R_{11}$ and a capacitor $C_{11}$ connected in series and also to the output side of the stabilization compensator 35 via a resistor $R_{12}$. A non-inversion input terminal of the operational amplifier $IC_2$ is grounded.

Since the real part of a solution of a characteristic equation of (Equation 6) is 0, the control target P(s) is unstable. Thus, the control target P(s) will be stabilized.

Negative feedback from V2 to V6 in FIG. 6 is a stabilization compensator $K_2(s)$ and the control target P(s) is stabilized in the invention by causing the stabilization compensator $K_2(s)$ to have derivative characteristics. If $T_{D0}$ is a time constant, the transfer function of $K_2(s)$ is given by Equation 7 and that of a closed loop system consisting of P(s) and $K_2(s)$ is given by Equation 8:

$$K_2(s) = sT_{D0} \tag{7}$$

$$Q(s) = \frac{K_0 F(s)}{1 + K_0 F(s) H(s)} = \frac{K_0 \omega_0^2}{s^2 + K_0 T_{D0} \omega_0^2 s + \omega_0^2} \tag{8}$$

Figure 8:
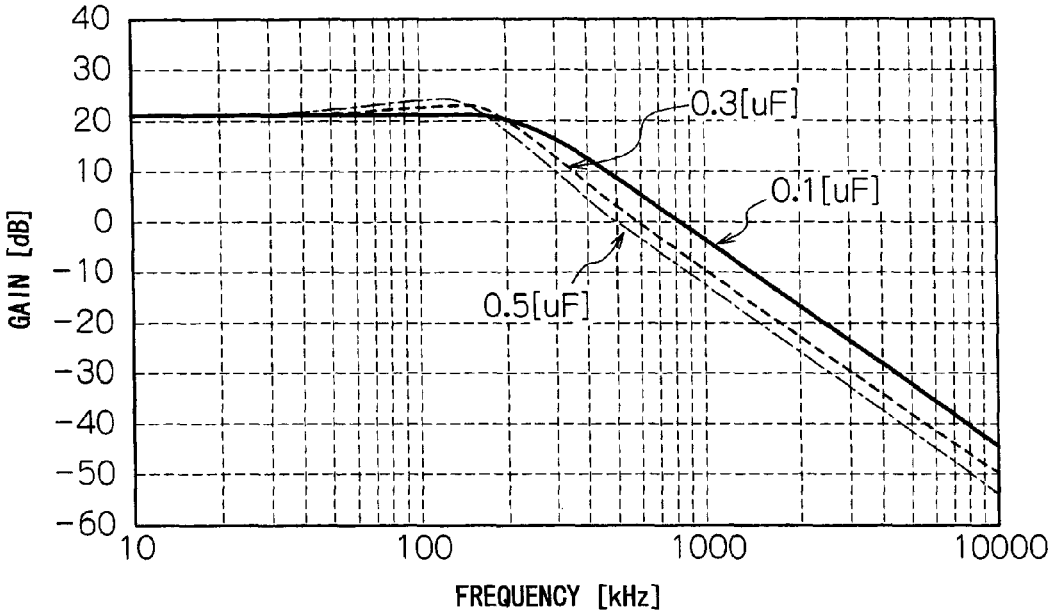
FIG. 8 is a diagram exemplifying frequency characteristics of a transfer function Q(s) from V3 to V2.

FIG. 8 is a diagram exemplifying frequency characteristics of the transfer function Q(s) from V3 to V2. According to FIG. 8, it is evident that resonance is suppressed compared with FIG. 4.

In a circuit configuration shown in FIG. 5, derivative characteristics based on Equation 7 can in principle be imparted. However, in reality, the gain in a high-frequency region increases to lead to vulnerability to noise and thus, as shown in Equation 9 below, a configuration using inexact differential was adopted:

$$K_2(s) = \frac{sC_{11}R_{11}}{1 + sC_{11}R_{11}} \tag{9}$$

Phase Lead Compensator

The first phase lead compensator 36 has a capacitor $C_{31}$ and a resistor $R_{31}$ connected in parallel and a resistor $R_{32}$. One end of a parallel circuit consisting of the capacitor $C_{31}$ and the resistor $R_{31}$ is connected to the output terminal of the filter 34. The other end is an output terminal of the first phase lead compensator 36 and is grounded via the resistor $R_{32}$.

A transfer function $K_{11}(s)$ of the first phase lead compensator 36 is given by Equation 10:

$$K_{11}(s) = \frac{1}{G_0} \frac{1 + sG_0T_{D1}}{1 + sT_{D1}} \tag{10}$$

$G_0$ and $T_{D1}$ in Equation 10 satisfy Equation 11 and Equation 12 respectively:

$$G_0 = 1 + \frac{R_{31}}{R_{32}} \tag{11}$$

$$T_{D1} = C_{31} \frac{R_{31}R_{32}}{R_{31} + R_{32}} \tag{12}$$

$G_0$ gives a DC voltage amplification factor of the whole drive circuit 30 from the input $V_1$ to the output V2. Since the voltage amplification factor is set to be 20 (26 [dB]) from what has been described above, $G_0$=20.

The second phase lead compensator 37 is connected to the output side of the first phase lead compensator 36 in series and has an operational amplifier $IC_3$. A non-inversion input terminal of the operational amplifier $IC_3$ is grounded via the resistor $R_{32}$. An inversion input terminal of the operational amplifier $IC_3$ is connected to an output terminal of the operational amplifier $IC_3$ via a resistor R42 and also is grounded via a capacitor C and a resistor R connected in series. Then, the output terminal of the operational amplifier $IC_3$ is connected to the series compensator 38 via a resistor $R_{51}$.

A transfer function $K_{12}(s)$ of the second phase lead compensator 37 is given by Equation 13:

$$K_{12}(s) = \frac{1 + s\alpha T_{D2}}{1 + sT_{D2}} \tag{13}$$

where $\alpha$ and $T_{D2}$ satisfy Equation 14 and Equation 15 respectively:

$$T_{D2} = C_{41}R_{41} \tag{14}$$

$$\alpha = 1 + \frac{R_{42}}{R_{41}} \tag{15}$$

The operational amplifier $IC_3$ also has a function to act as a buffer between the first and second phase lead compensators 36 and 37 and the subsequent series compensator 38 by receiving a high input impedance signal from the first phase lead compensator 36 and converting the received signal into a low impedance signal.

A phase lead compensator constituted by the first and second phase lead compensators 36 and 37 described above has characteristics shown below.

Figure 9:
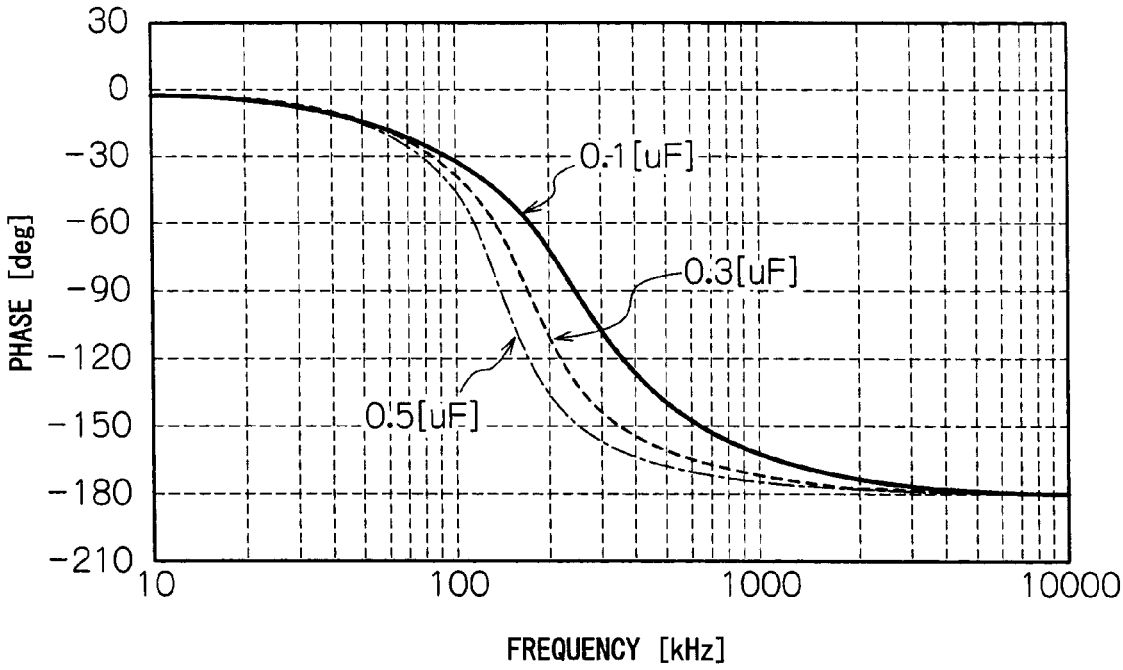
FIG. 9 is a diagram showing phase characteristics of a stabilized control target Q(s)

FIG. 9 is a diagram showing phase characteristics of the stabilized control target Q(s). Since there is almost no phase margin (a margin of phase delay with respect to −180 degrees) near 1 [MHz] when the load is 0.5 [μF], there is a possibility of oscillation if feedback is received as it is.

Since Q(s) is a second-order lag system, second-order phase lead compensation $K_1(s)$ obtained by cascade-connecting first-order phase lead compensation is used in the exemplary embodiment.

Figure 10:
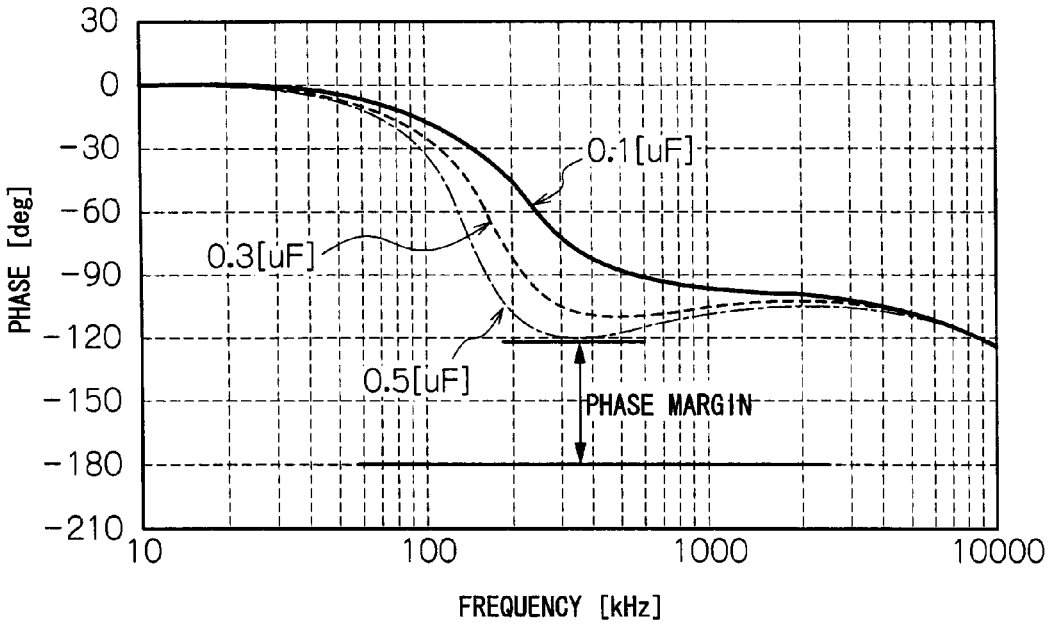
FIG. 10 is a diagram showing phase characteristics of the control target Q(s) when phase lead compensation is made.

If the output of the phase lead compensation $K_1(s)$ is V8, phase voltage characteristics from $V_3$ to $V_8$ are like those shown in FIG. 10. In comparison with FIG. 9, FIG. 10 shows an improvement of the phase margin by 60 [deg] when the load capacity is 0.5 [μF]. Accordingly, negative feedback can be received with stability with respect to load fluctuations.

Series Compensator 38

The series compensator 38 has the operational amplifier $IC_4$. An inversion input terminal of the operational amplifier $IC_4$ is connected to the output terminal of the operational amplifier $IC_4$ via a resistor R52 and a capacitor C51 connected in series. The driving signal $V_1$ generated by the driving signal generation circuit 21 is input into a non-inversion input terminal of the operational amplifier $IC_4$. The output terminal of the operational amplifier $IC_4$ is connected to the non-inversion input terminal of the comparator $IC_1$ via the resistor $R_{21}$.

The series compensator 38 determines an error between the driving signal $V_1$ and the signal $V_8$ whose phase is advanced from that of the output $V_2$ of the filter 34 and performs an operation to amplify the error and that to integrate the error.

Particularly the latter performs an operation in such a way that a drive circuit becomes a 1-type servo control system. That is, if the input signal $V_1$ is DC due to an integral action, the steady-state deviation of the output signal $V_2$ becomes 0 with respect to a target value. Voltage characteristics of the signals $V_1$ and $V_8$ and output $V_3$ are given by Equation 16:

$$V_3 = A(s)(V_1 - V_8) \tag{16}$$

where A(s) satisfies Equations 17 to 19:

$$A(s) = K_P\left(1 + \frac{1}{sT_I}\right) \tag{17}$$

$$T_I = C_{52}R_{52} \tag{18}$$

$$K_P = \frac{R_{52}}{R_{51}} \tag{19}$$

Adder

The resistor $R_{21}$ and a resistor $R_{22}$ shown in FIG. 5 add the output $V_3$ of the series compensator 38 and output $V_4$ of the stabilization compensator 35. The added signal $V_5$ is input into the non-inversion input terminal of the comparator $IC_1$. Since the stabilization compensator 35 performs an inversion operation due to Equation 9, the relationship among $V_3$, $V_4$ and $V_5$ is given by Equation 20 when it is assumed that $R_{21}=R_{22}$.

$$V_5 = \frac{1}{2}(V_3 - V_4) \tag{20}$$

Operation

When the driving signal $V_1$ is supplied to the drive circuit 30 configured as described above, the series compensator 38 compares the driving signal $V_1$ and the output signal $V_2$ for which phase lead compensation has been made and outputs the signal $V_3$ set to a level in accordance with an error thereof. The switching voltage amplifier circuit 33 compares the triangular wave and the signal $V_3$ to perform pulse width modulation and voltage amplification. An output signal of the switching voltage amplifier circuit 33 is supplied to the piezoelectric head 10 via the filter 34.

Here, the control target, that is, the transfer function P(s) from the signal V5 of the switching voltage amplifier circuit 33 to the output V2 of the filter 34 is represented by (Equation 6), as described above. (Equation 6) has no first-order term concerning s in the denominator and has resonance characteristics and thus, lacks stability.

Therefore, the stabilization compensator 35 provides the first-order term concerning s to the denominator of the transfer function P(s) of the control target (corresponding to (Equation 7)) by providing derivative characteristics and configures a closed loop (corresponding to (Equation 8)) to stabilize the control target.

However, in phase characteristics of the transfer function Q(s) of the control target stabilized by the stabilization compensator 35, there is almost no phase margin (a margin of phase delay with respect to −180 degrees) near 1 [MHz] when the load is 0.5 [μF]. Thus, there is a possibility of oscillation if feedback is received as it is.

In consideration of the fact that Q(s) is a second-order lag system, the first and second phase lead compensators 36 and 37 make second-order phase lead compensation for the output $V_2$. Thus, negative feedback is received with stability even if the load fluctuates.

Figure 11:
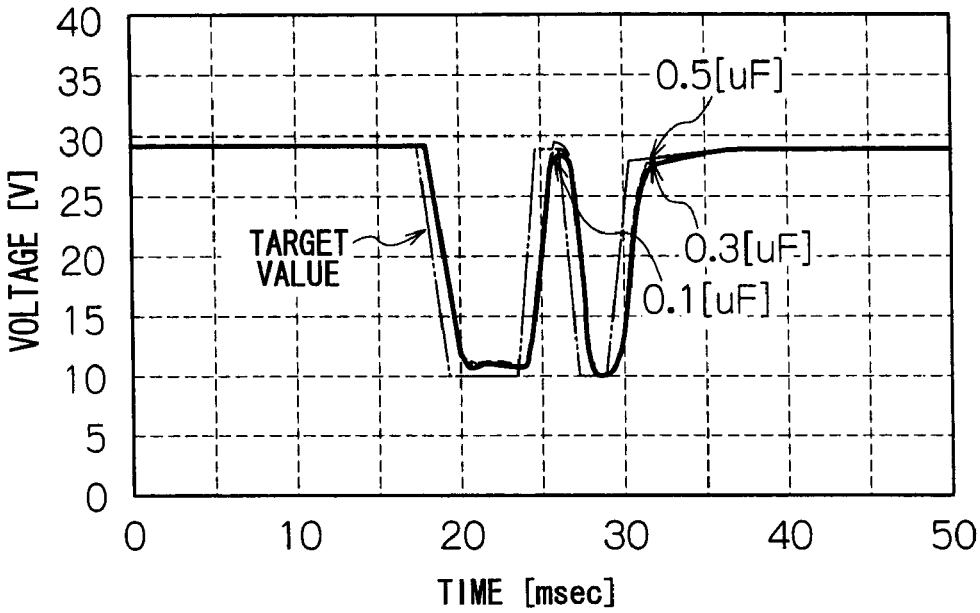
FIG. 11 is a diagram exemplifying drive characteristics of the drive circuit.

FIG. 11 is a diagram exemplifying drive characteristics of the drive circuit 30. Even if the load capacity fluctuates between 0.1 and 0.5 [μF], the output (the voltage of the piezoelectric element 11) of the filter 34 with respect to the target value remains almost the same, showing excellent low-sensitivity characteristics.

Second Exemplary Embodiment

Next, a second exemplary embodiment of the invention will be described. The same reference numerals are attached to the same circuits as those in the first exemplary embodiment and different aspects will be mainly described.

Excellent output of the filter 34 was obtained with respect to the target value in FIG. 11, but as is evident in characteristics near 20 [μsec], transitive-tracking properties of the target value is somewhat insufficient. Thus, an ink jet printer according to the second exemplary embodiment has, in addition to the low-sensitivity characteristics, a drive circuit 30A whose transitive-tracking properties have been improved.

Figure 12:
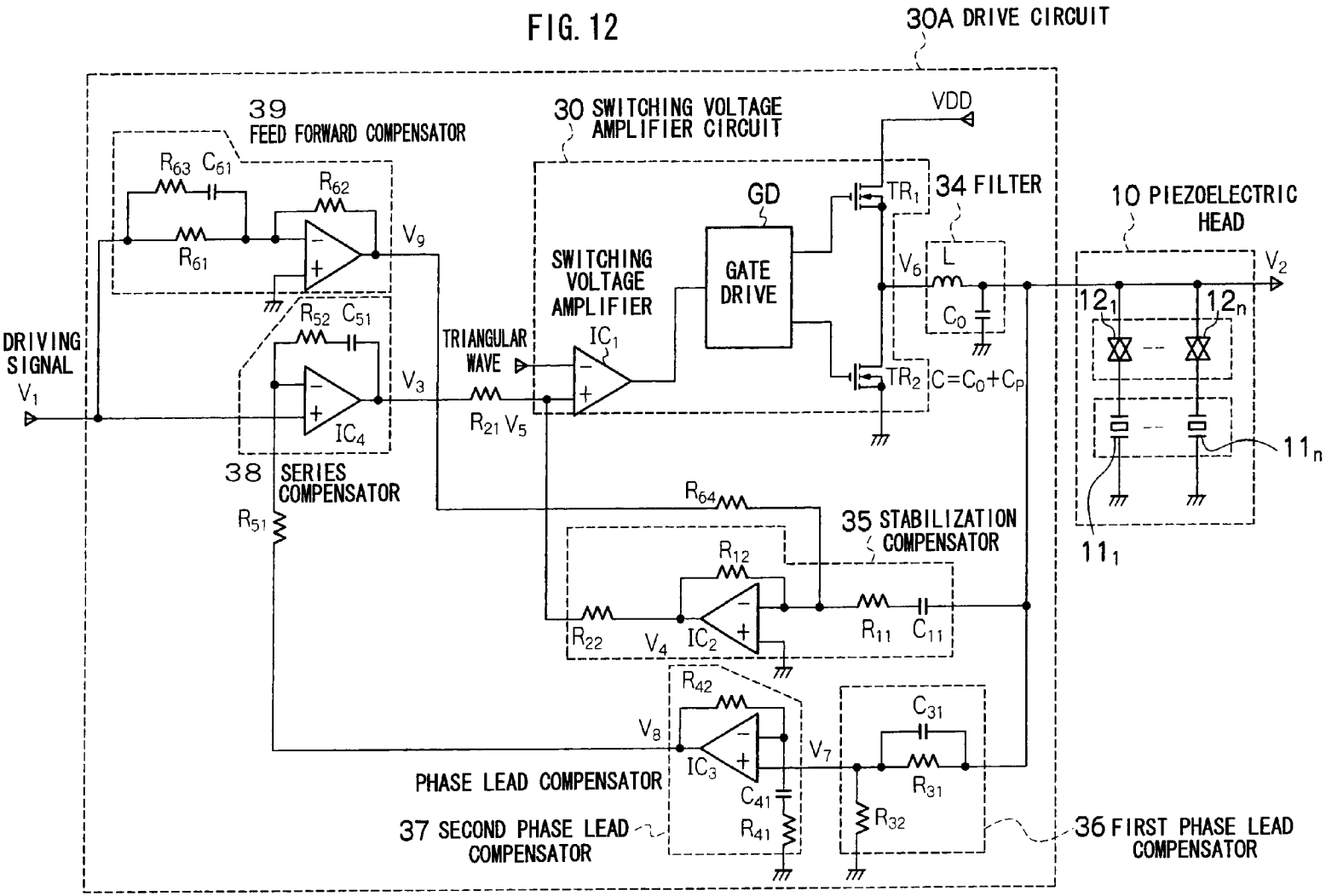
FIG. 12 is a circuit diagram showing the configuration of a drive circuit according to a second exemplary embodiment.
Figure 13:
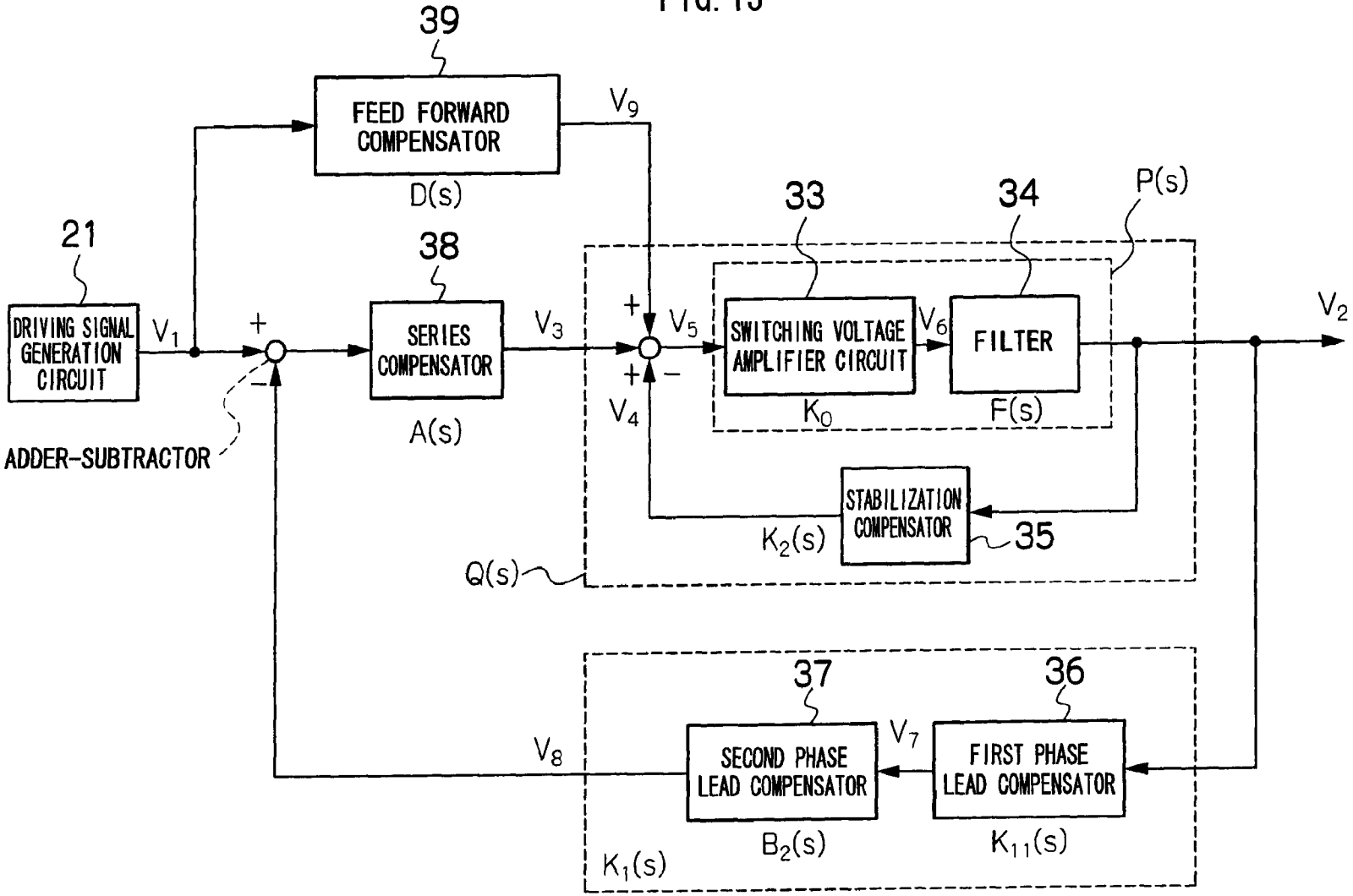
FIG. 13 is a diagram showing transfer functions of each of circuits constituting the drive circuit according to the second exemplary embodiment.

FIG. 12 is a circuit diagram showing the configuration of the drive circuit 30A. FIG. 13 is a diagram showing transfer functions of each of circuits constituting the drive circuit 30A.

The drive circuit 30A has, in addition to the configuration shown in FIG. 5, a feed forward compensator 39 for making feed forward compensation to the input $V_5$ of the switching voltage amplifier circuit 33 from the input $V_1$.

Feed Forward Compensator 39

The feed forward compensator 39 has an operational amplifier $IC_5$, resistors $R_{61}$, $R_{62}$ and $R_{63}$, and a capacitor $C_{61}$. An inversion input terminal of the operational amplifier $IC_5$ is connected to the non-inversion input terminal of the operational amplifier $IC_4$ via the resistor $R_{61}$. The resistor $R_{61}$ is connected in parallel to the resistor $R_{63}$ and the capacitor $C_{61}$ connected in series. A non-inversion input terminal of the operational amplifier $IC_5$ is grounded. An output terminal of the operational amplifier $IC_5$ is connected to the inversion input terminal of the operational amplifier $IC_5$ via the resistor $R_{62}$ and also to the inversion input terminal of the operational amplifier $IC_2$.

A transfer function G(s) of the drive circuit 30A from the input $V_1$ to the output V2 of the filter 34 is given by Equation 21 below:

$$G(s) = \frac{V2(s)}{V1(s)} = \frac{A(s)Q(s)}{1 + A(s)K_1(s)Q(s)} + \frac{D(s)Q(s)}{1 + A(s)K_1(s)Q(s)} \tag{21}$$

The first term in Equation 21 is transfer characteristic itself when there is no feed forward (FIG. 6) and a response to a target value is shown in FIG. 4. The second term shows an effect of a feed forward compensator D(s) and the response to the target value may be improved if D(s) has a high-frequency emphasis property.

Assume that the transfer characteristic from the input $V_1$ to the output V9 of the feed forward compensator 39 is given by (Equation 22). However, Q(s) changes depending on load capacity and thus, Q(s) at maximum load ($C_p$=0.5 [μF]) is assumed.

$$D(s) = \frac{1}{K_1(s)Q(s)} \tag{22}$$

Figure 14:
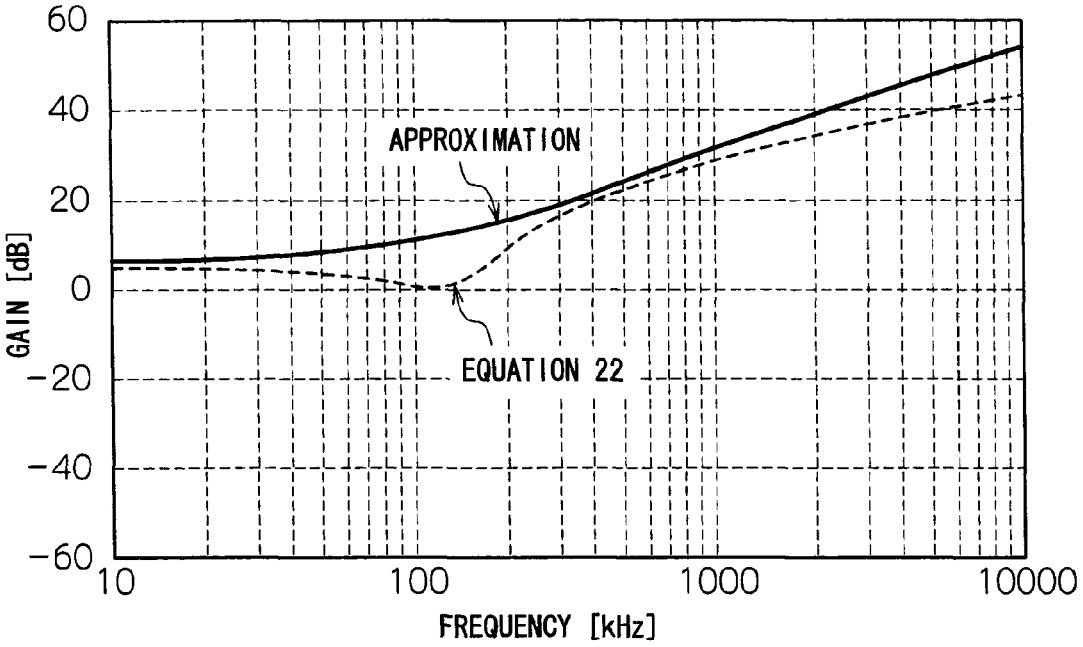
FIG. 14 is a diagram exemplifying frequency characteristics of a feed forward compensator D(s)

FIG. 14 is a diagram exemplifying frequency characteristics of the feed forward compensator D(s). The feed forward compensator D(s) has a high-frequency emphasis property. However, this property is complex and is thus approximated by a simple first-order high-frequency emphasis property for actually configuring a circuit.

FIG. 12 shows an example using the operational amplifier $IC_5$. Here, a transfer characteristic from the input $V_1$ to the output $V_9$ is given by Equation 23:

$$D_0(s) = -K_F \frac{1 + \beta s T_{D3}}{1 + s T_{D3}} \tag{23}$$

where $K_F$ and β satisfy Equations 24 to 26:

$$K_F = \frac{R_{62}}{R_{61}} \tag{24}$$

$$\beta = 1 + \frac{R_{61}}{R_{63}} \tag{25}$$

$$T_{D3} = C_{61} R_{63} \tag{26}$$

Equation 23 shows an inversion operation. Here, the stabilization compensator Q(s) in FIG. 12 also shows an inversion operation and thus, the number of operational amplifiers is saved by inverting $V_9$ before addition by the operational amplifier $IC_2$.

Figure 15:
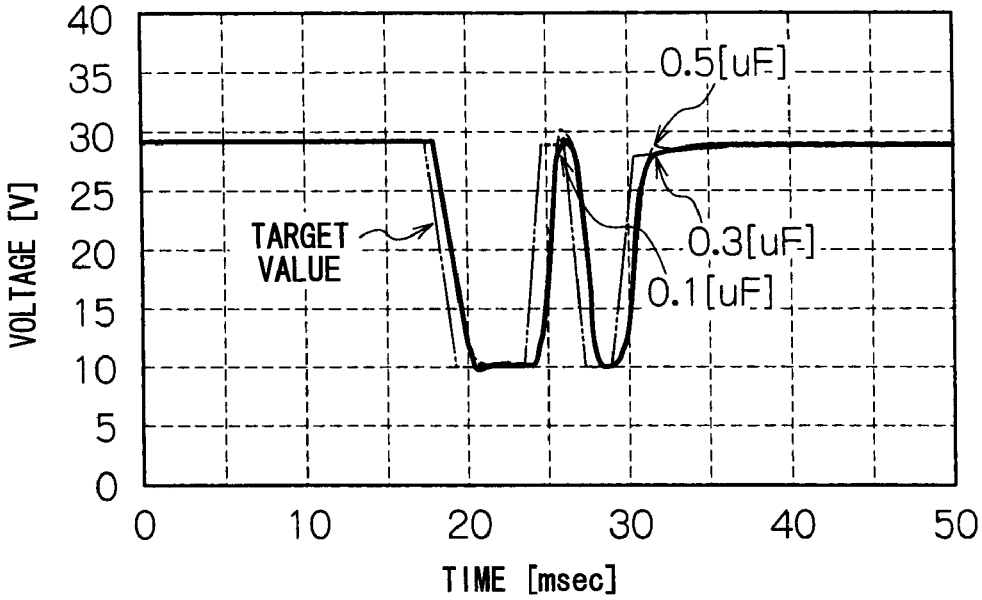
FIG. 15 is a diagram exemplifying drive characteristics of the drive circuit according to the second exemplary embodiment.

FIG. 15 is a diagram exemplifying drive characteristics of the drive circuit 30A. The output (the voltage of the operational amplifier 11) of the filter 34 hardly changes even if the load capacity fluctuates between 0.1 and 0.5 [μF], showing excellent low-sensitivity characteristics. Further, while insufficient tracking of the target value is observed near 20 [μsec] in FIG. 11, insufficient tracking is improved in FIG. 15.

While the present invention has been illustrated and described with respect to some specific exemplary embodiments thereof, it should be understood that the present invention is by no means limited thereto and encompasses all changes and modifications which will become possible without departing from the spirit and scope of the invention.

What is claimed is:

1. A capacitive load driving circuit, comprising:

a filter comprising an inductor, one end of which is connected to an input terminal and another end of which is connected to an output terminal, and a capacitor having a fixed electrostatic capacity, and one electrode of which is connected to the output terminal, and another electrode of which is grounded;

a plurality of capacitive loads, each of which is connected in parallel to the capacitor and any one of the capacitive loads is driven;

a phase lead compensator that advances a phase of an output signal of the filter;

a series compensator that determines an error between a driving signal and an output signal of the phase lead compensator and outputs a signal on which a proportional integral operation has been performed;

a stabilization compensator that is configured independently of the phase lead compensator and outputs a signal obtained by performing a derivative action on the output signal of the filter;

a voltage comparison unit that compares a summed voltage between a signal output from the series compensator and a signal output from the stabilization compensator, with a voltage of predetermined triangular waves and outputs a pulse width modulation signal; and a voltage amplification unit that amplifies the voltage of the pulse width modulation signal output from the voltage comparison unit and supplies the amplified pulse width modulation signal to the input terminal of the filter.

2. The capacitive load driving circuit of claim 1, wherein the phase lead compensator comprises a first phase lead compensator that attenuates the voltage of an output signal of the filter and also outputs a signal obtained by advancing the phase of the output signal and a second phase lead compensator that comprises an impedance conversion function and also advances the phase of an output signal of the first phase lead compensator.

3. The capacitive load driving circuit of claim 1, further comprising:

a feed forward compensator that performs high-frequency emphasis on the driving signal and adds the signal on which the high-frequency emphasis is performed to output of the series compensator.

4. The capacitive load driving circuit of claim 2, further comprising:

a feed forward compensator that performs high-frequency emphasis on the driving signal and adds the signal on which the high-frequency emphasis is performed to output of the series compensator.

5. The capacitive load driving circuit of claim 1, wherein the plurality of capacitive loads comprises:

a plurality of piezoelectric elements;

a plurality of liquid holding units that hold a liquid in a state of contact with each of the plurality of piezoelectric elements, and a plurality of switch elements, each of which is connected to one of the piezoelectric elements in series and supplies a voltage to the corresponding connected piezoelectric element by being turned on or turned off, and wherein the liquid holding units eject droplets in accordance with vibration of the piezoelectric elements when the voltage is applied to the piezoelectric elements via the switch elements.

6. The capacitive load driving circuit of claim 2, wherein the plurality of capacitive loads comprises:

a plurality of piezoelectric elements;

a plurality of liquid holding units that hold a liquid in a state of contact with each of the plurality of piezoelectric elements, and a plurality of switch elements, each of which is connected to one of the piezoelectric elements in series and supplies a voltage to the corresponding connected piezoelectric element by being turned on or turned off, and wherein the liquid holding units eject droplets in accordance with vibration of the piezoelectric elements when the voltage is applied to the piezoelectric elements via the switch elements.

7. The capacitive load driving circuit of claim 3, wherein the plurality of capacitive loads comprises:

a plurality of piezoelectric elements;

a plurality of liquid holding units that hold a liquid in a state of contact with each of the plurality of piezoelectric elements, and a plurality of switch elements, each of which is connected to one of the piezoelectric elements in series and supplies a voltage to the corresponding connected piezoelectric element by being turned on or turned off, and wherein the liquid holding units eject droplets in accordance with vibration of the piezoelectric elements when the voltage is applied to the piezoelectric elements via the switch elements.

8. A droplet ejection apparatus, comprising:

a driving signal generator that generates a driving signal;

a drive unit comprising a filter comprising;

an inductor, one end of which is connected to an input terminal and another end of which is connected to an output terminal, a capacitor having a fixed electrostatic capacity, one electrode of which is connected to the output terminal, and another electrode of which is grounded, a phase lead compensator that advances a phase of an output signal of the filter, a series compensator that determines an error between a driving signal and an output signal of the phase lead compensator and outputs a signal on which a proportional integral operation has been performed, a stabilization compensator that is configured independently of the phase lead compensator and outputs a signal obtained by performing a derivative action on an output signal of the filter, a voltage comparison unit that compares a summed voltage between a signal output from the series compensator and a signal output from the stabilization compensator, with a voltage of predetermined triangular waves, and outputs a pulse width modulation signal, and a voltage amplification unit that amplifies the voltage of the pulse width modulation signal output from the voltage comparison unit and supplies the amplified pulse width modulation signal to the input terminal of the filter; and a piezoelectric head comprising:

a plurality of piezoelectric elements, each of which is connected in parallel to the capacitor of the drive unit, a plurality of liquid holding units that hold a liquid in a state of contact with each of the plurality of piezoelectric elements, and a plurality of switch elements, each of which is connected to one of the piezoelectric elements in series and supplies a voltage to the corresponding connected piezoelectric element by being turned on or turned off, wherein the liquid holding units eject droplets in accordance with vibration of the piezoelectric elements when the voltage is applied to the piezoelectric elements via the switch elements; and a piezoelectric element selection unit that selects any one of the plurality of piezoelectric elements as a target to be driven based on image data.

* * * * *